United States Patent [19]

Salomon

[11] 3,992,030

[45] Nov. 16, 1976

[54] DEVICE FOR MOUNTING A BRAKE ON A SKI

[75] Inventor: Georges Pierre Joseph Salomon, Annecy, France

[73] Assignee: Sa Etablissements Francois Salomon & Fils, France

[22] Filed: Apr. 1, 1975

[21] Appl. No.: 563,956

[30] Foreign Application Priority Data

Apr. 2, 1974 France ..... 74.11638

[52] U.S. Cl. ..... 280/605; 280/633

[51] Int. Cl.[2] ..... A63C 7/10

[58] Field of Search ..... 280/11.13 C, 11.13 D, 280/11.13 B, 11.13 Z, 11.13 Y, 11.13 G, 11.35 C, 11.35 H; 210/605, 504, 633

[56] References Cited

UNITED STATES PATENTS

| | | | |
|---|---|---|---|
| 2,194,979 | 3/1940 | Jett | 280/11.13 C |
| 2,614,858 | 10/1952 | Pierce, Jr. | 280/11.35 C |
| 3,219,359 | 11/1965 | Schneider | 280/11.35 H |
| 3,249,365 | 5/1966 | Beyl | 280/11.35 T |
| 3,715,126 | 2/1973 | Schwarz | 280/11.13 B |
| 3,741,575 | 6/1973 | Bortoli | 280/11.13 B |

FOREIGN PATENTS OR APPLICATIONS

| | | | |
|---|---|---|---|
| 137,700 | 5/1934 | Austria | 280/11.13 C |
| 137,709 | 5/1934 | Austria | 280/11.13 C |

*Primary Examiner*—M. H. Wood, Jr.
*Assistant Examiner*—Milton L. Smith
*Attorney, Agent, or Firm*—Robert E. Burns; Emmanuel J. Lobato; Bruce L. Adams

[57] ABSTRACT

A device for mounting a brake on a ski having a safety fastening comprising a longitudinal slide bar attached to the ski comprises a brake element slidably mounted on the slide bar. The brake element is secured in place and is so fitted that it cannot be detached from the slide bar in the transverse direction.

6 Claims, 5 Drawing Figures

FIG. 1
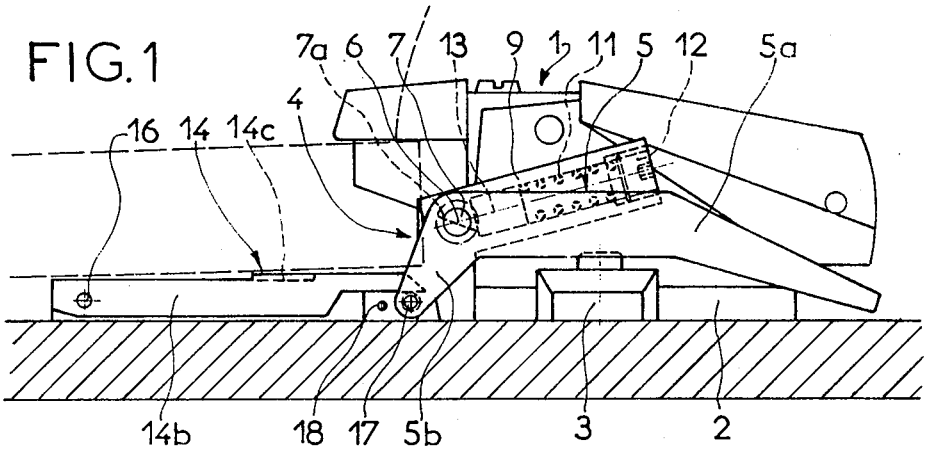
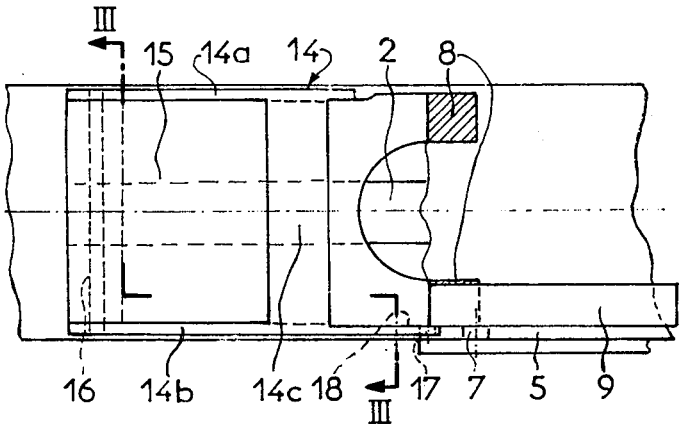
FIG. 2
FIG. 4
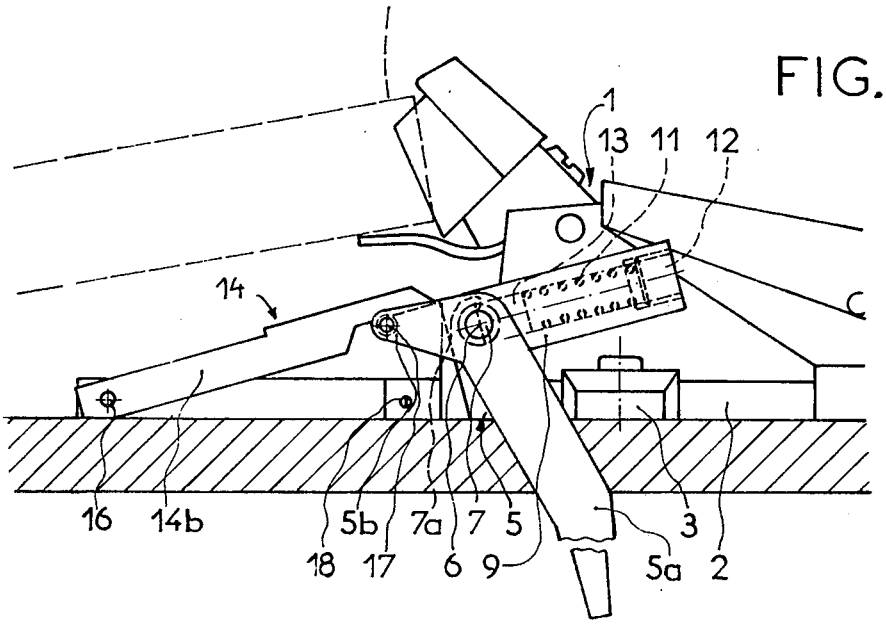

DEVICE FOR MOUNTING A BRAKE ON A SKI

BACKGROUND OF THE INVENTION

The present invention relates to a device for mounting a brake on a ski having a safety fastening.

Various ski brakes are already known of which the function is to immobilize the ski when, following a fall which actuates the safety fastening, the ski comes off the user's ski-ing boot.

Up to the present the brakes mounted on skis have been independent of the fastening and separately mounted. This involves the drawback that additional holes have to be bored in the ski in order to mount the brake, besides which the position of the later is permanently fixed, whatever the length of the boot.

A first attempt has been made to remedy this drawback by mounting the brake on the fastening itself. This makes it unnecessary to bore additional holes in the ski; the brake is also satisfactorily positioned at all times in relation to boots of different lengths when the fastening to which it is affixed is removed. The known method of mounting the brake on the fastening nevertheless entails certain disadvantages, the actual operation of mounting it thereon being cumbersome, besides necessitating the additional machining of the fastening beforehand so that it can accommodate the screws by which the brake is secured.

SUMMARY OF THE INVENTION

The main purpose of the present invention is to eliminate these drawbacks.

For this purpose, this device for mounting a brake on a ski having a safety fastening comprising a longitudinal slide bar attached to the ski is characterized by the fact that it comprises a brake element slidably mounted on the slide bar of the fastening and fitted onto this slide bar so that it cannot become detached therefrom transversally, and also means for securing the brake element on the slide bar.

The invention provides a very convenient means of mounting the brake on the fastening. The fact is that the brake merely has to be attached longitudinally to the actual fastening affixed to the ski after which the brake is secured in position on the slide bar, e.g. by means of a simple screw. This mounting device makes it unnecessary to machine the fastening in advance, as it makes use of an existing element of this latter, i.e. the slide bar serving for longitudinal adjustment and not modified. It also enables the longitudinal position of the brake in relation to the fastening to be regulated as desired. Finally, the brake is guided on the slide bar over a considerable length, being thus rendered firmer.

BRIEF DESCRIPTION OF THE DRAWING

An embodiment of the present invention will be described below, by way of an example, without any limitative effect, and by reference to the accompanying drawing, in which:

FIG. 1 is a fragmentary elevation view of a rear fastening mounted on a ski and having a ski brake attached to it, the brake being in the inoperative position.

FIG. 2 is a fragmentary plan view showing the mounting of the brake, the fastening being assumed to have been removed.

FIG. 4 is a fragmentary elevation view similar to that of FIG. 1, the brake being shown in the operative braking position.

DESCRIPTION OF THE PREFERRED EMBODIMENT

Figure 3:
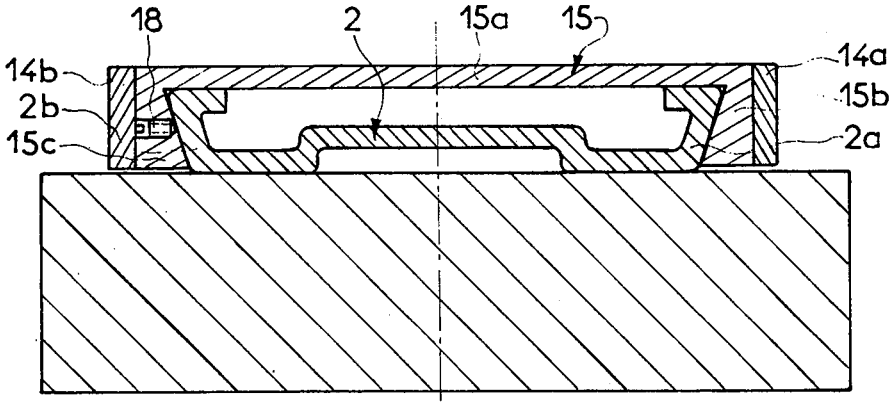
FIG. 3 is a cross section view along the section line III—III of FIG. 2.

FIGS. 1–4 illustrate a rear safety fastening marked 1 as a whole and adjustably mounted, in a manner known per se, by means of a longitudinal slide bar 2 affixed to a ski, in the appropriate position, by a clamp 3 and by screws not shown in the drawing. A ski brake 4 of any known type is associated with the fastening 1. This brake may comprise, as in the example shown in the drawing, one or two arms 5 situated at the side and pivoting about a transversal shaft 6. Each securing arm 5 has the shape of a lever with two branches and comprises a rear branch **5*a* taking the form of a spade, designed to dig itself into the snow, when the brake is in the operative position, and a shorter front branch 5*b*. In the inoperative position (FIG. 1) the rear branch 5*a* extends in a substantially horizontal direction towards the rear, while the front branch 5*b*** is inclined downwards and forwards.

Each arm 5 is integral with a pivot 7 rotatably mounted in a bearing provided in a vertical column 8 integral with the rear part of a heel piece 15 supporting the brake. This column has a prolongation extending upwards and backwards and consisting of a sleeve 9 inside which is mounted a compression spring 11 which may rest by its outer end on a calibration plug 12 screwed into the internally threaded end part of the sleeve 9. The spring 11 likewise rests by its internal end on a piston 13 or any component serving a similar purpose (ball etc.).

The bearing in which the pivot 7 turns leads into the internal cavity of the sleeve 9, in which position the pivot 7 has a diametric supporting surface **7*a* against which the piston 13 is pressed by the force of the spring 11.**

The ski brake also comprises a "re-shoeing pedal" 14 of which the front part is articulated to the heel piece 15 in such a way as to be rotatable about a transversal shaft 16. The pedal 14 consists essentially of two vertical lateral branches **14*a* and 14*b* of which the front ends are articulated to the shaft 16 and of which the respective rear parts are interconnected by a transversal bar 14*c* on which the heel of the ski boot is supported. The branches 14*a* and 14*b* are prolonged towards the rear, their extreme rear parts being situated above transversal lugs 17 extending in the direction of the longitudinal axis and borne by the front branches 5*b* of the arms 5. The pedal 14 thus rests permanently on the lugs 17 and acts on the arms 5.**

According to the invention the heel piece 15 which belongs to the brake and to which the "re-shoeing pedal" 14 is articulated forms a "link block" engaging the longitudinal slide 2 of the fastening 1 and fitting onto this latter in such a way that it cannot become detached transversally and particularly upwards. For this purpose the heel piece 15 and the slide 2 have complementary cross sectional profiles preventing them from coming apart.

This transversal interconnection can be provided in a number of different ways. For example, as shown in FIG. 3, the slide 2 and the heel piece 15 are assembled on the dovetail principle. For this purpose the heel piece 15 has a horizontal upper web 15*a* extending downwards in the form of two side flanges 15*b* and 15*c* forming a dovetail assembly with the flanges 2*a* and 2*b* of the slide bar 2. In this case the flanges 15*b* and 15*c* are situated outside the flanges 2*a* and 2*b* of the slide bar 2 and consequently enclose these latter.

The flanges of the slide bar 2 could also be provided with longitudinal ribs (or grooves) interacting with the longitudinal grooves (or ribs, respectively) provided on the heel piece 15 and corresponding thereto.

Figure 5:
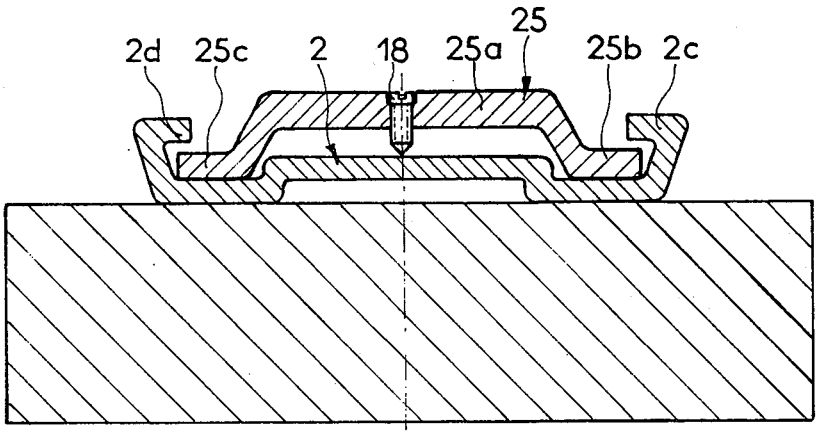
FIG. 5 is a cross section view showing an alternative method of connection between the brake and the slide bar of the fastening.

In the alternative embodiment shown in FIG. 5 the heel piece 25 has a horizontal upper web 25*a* of which the two longitudinal sides extend downwards in the form of flanges which are first inclined at an angle and which terminate in horizontal extremities 25*b* and 25*c* extending outwards. These extremities engage grooves of hook-shaped cross section turned inwards and forming the extremities 2*c* and 2*d* of the flanges 2*a* and 2*b* of the slide bar 2.

The heel piece 15 and the slide bar 2 could naturally be fitted together by any other method.

The heel piece 15 is secured in position on the slide bar 2 by any suitable means, e.g. by the aid of a simple set screw 18 inserted in an internally threaded hole provided in one of the flanges 15*c* of the heel piece 15, its end coming to rest against the external surface of the flange 2*b* belonging to the slide bar 2 and situated opposite to it (FIG. 3).

The set screw 18 can also be screwed into the web of the heel piece, in which case it is vertical. This arrangement is illustrated in FIG. 5, where it may be seen that the screw 18 is screwed into the web 25*a* of the heel piece 15 and is supported by its end on the central part of the slide bar 2. The screw 18 can also pass through a non-threaded hole provided in the heel piece 15 and be screwed into a threaded hole provided in the slide bar 2.

It may be seen from the foregoing that the ski brake 4 is mounted on the ski in a very simple manner: the fact is that the entire ski brake unit 4 need only be attached to the slide bar 2 on the left as viewed in the drawing. The heel piece 15 is then moved over the slide bar 2 from the left towards the right until the brake occupies the correct position. At this moment all that is required is to secure it in position by means of the screw 18, this operation being a very simple and rapid one. It also makes it unnecessary to bore any additional holes in the ski.

The position of the ski brake in relation to the fastening 1 may be selected as desired. When the said fastening is moved in order to adapt it to ski boots of different lengths, the ski brake 4, of which the heel piece 15 is integral with the slide bar 2, follows the movement.

As the heel piece 15 is guided by the slide bar 2 over practically its entire length, the ski brake is extremely firm on the slide bar and consequently on the ski itself.

When the safety device comes into operation and the ski is detached from the boot the ski brake 4 pivots from its inoperative position shown in FIG. 1 to its operative position shown in FIG. 4. The fact is that when the heel of the ski boot leaves the "re-shoeing pedal" 14, the spring 15 which thrusts the piston 13 forwards causes the pivot 7 to rotate clockwise until the piston 13 comes to rest against the diametral surface 7*a* (FIG. 4). This results in a corresponding pivoting movement of the arm 5, and the rear branch 5*a* of this latter extends under the heel of the ski and is thus able to enter the snow.

When the user puts his ski on again the action of the heel of his ski boot on the pedal 14 causes the arm 5 to perform the opposite movement, thus returning to its retracted inoperative position (FIG. 1).

The mounting device according to the invention can be applied to any type of make at present known.

In one embodiment the arm 5 can pivot about a fixed swivel pin borne by the column 8 integral with the link block forming the heel piece 15, the arm 5 being returned to its operative braking position by a spring attached both to this arm, at a point situated between the pivoting axis 6 and the extremity of the rear branch 5*a*, and also at a point on the heel piece 15, so that this spring always tends to pivot the arm 5 clockwise. The pedal 14 can be eliminated and replaced by a simple rod interconnecting the ends of the front branches 5*b* of the arms 5.

I claim:

1. For use with a ski binding having a slide bar extending longitudinally of the ski and mounted in a fixed position in use on the ski, a ski brake comprising a heel plate having coupling means for slidably engaging said slide bar longitudinally of the ski for removably coupling and fixing said ski brake thereon without movement transverse of said slide bar, means on said heel plate to releasably fix said heel plate axially on said slide bar, said heel plate having pivotally mounted thereon at least one brake lever, means on said heel plate pivotally mounting said brake lever, biasing means constantly biasing said brake to an operative position for braking a ski when mounted thereon, pedal means pivotally mounted on a forward end of said heel plate extending toward a rear end of said ski in use and having means cooperative with said brake lever for actuating said brake lever to a retracted position and for rendering said biasing means ineffective when said pedal is pressed in a direction downwardly toward said ski with a predetermined pressure overcoming said biasing means.

2. For use with a ski binding having a slide bar extending longitudinally of the ski and mounted in a fixed position, a ski brake according to claim 1, in which said coupling means for slidably engaging said slide bar comprises means for making a dovetail connection with said slide bar.

3. For use with a ski binding having a slide bar extending longitudinally of the ski and mounted in a fixed position, a ski brake according to claim 1, in which said slide bar has surfaces defining a channel and flanges extending inwardly toward said channel, said heel plate coupling means comprising lateral flanges slidable in said channel and underlying said flanges on said slide bar when said heel plate is slid axially into said channel.

4. For use with a ski binding having a slide bar extending longitudinally of the ski and mounted in a fixed position in use on a ski, a ski brake according to claim 1, in which said means pivotally mounting said brake lever comprises a column integral with said heel plate, and a pivot on said column.

5. For use with a ski binding having a slide bar extending longitudinally of the ski and mounted in a fixed position in use on a ski, a ski brake according to claim 1, in which said pedal means comprises a lever extending toward said brake lever and coactive therewith.

6. For use with a ski binding having a slide bar extending longitudinally of a ski and mounted in a fixed position in use on the ski, a ski brake according to claim 1, and including a second pivotally mounted brake lever spaced from the first-mentioned brake lever, both brake levers being disposed in use on opposite sides of the ski, second biasing means biasing said second brake lever to an operative position for braking said ski, and second pedal means pivotally mounted on a forward end of said heel plate extending toward a rear end of said ski in use and having means cooperative with said second brake lever for actuating said second brake lever to a retracted position and for rendering said second biasing means ineffective when said second pedal means is pressed in a direction downwardly toward said ski with a predetermined pressure overcoming said second biasing means.

* * * * *